US005483764A

United States Patent [19]

Lin

[11] Patent Number: 5,483,764

[45] Date of Patent: Jan. 16, 1996

[54] STRUCTURE OF BOTTLE FOR DECORATION AND VIEWING

[76] Inventor: Jen-Chao Lin, No. 170 Hai Kou Li, Chunan, Miao Li Hsien, Taiwan

[21] Appl. No.: 241,921

[22] Filed: May 12, 1994

[51] Int. Cl.[6] ..... G09F 19/00

[52] U.S. Cl. ..... 40/426; 40/411; 446/131

[58] Field of Search ..... 40/426, 409, 410, 40/411; 446/129, 131, 139

[56] References Cited

U.S. PATENT DOCUMENTS

| | | | |
|---|---|---|---|
| 2,220,249 | 10/1940 | Dunmore | 40/426 |
| 3,707,290 | 12/1972 | Birnkrant | 446/129 X |
| 4,011,674 | 3/1977 | Jacobson | 40/426 |
| 4,568,301 | 2/1986 | Hawley, Jr. | 446/134 |
| 4,578,044 | 3/1986 | Saitoh | 446/134 |
| 5,050,876 | 9/1991 | Chuang | 40/426 X |

*Primary Examiner*—Brian K. Green

[57] ABSTRACT

A structure of a viewing bottle, especially one which uses the mutual rejection force of those having the same polarity to generate a flying and dancing scene of figurines of insects, the bottle has on its bottom a layer of magnetic iron and a lot of flowers and grasses a cover which covers the bottle has suspended from a lower surface many figurines. The figurines are suspended from lines of differing lengths, and have differing weights. These figurines posses the same polarity as that of the magnetic iron of the bottle, hence when the cover and the bottle body are assembled, the figurines create a flying and dancing scene above the flowers and grasses due to the repulsing forces created by the polarity of the magnetic elements.

2 Claims, 4 Drawing Sheets

STRUCTURE OF BOTTLE FOR DECORATION AND VIEWING

BACKGROUND OF THE INVENTION

1. Field of the Invention

The present invention relates to the structure of a bottle for decoration and viewing, and especially to one which can have a plurality of playthings such as figurines of insects hanged therein danced and flown above a plurality of flowers and grasses for viewing or decoration.

2. Description of the Prior Art

There are quite a lot of kinds of bottle for viewing in the market, they can be divided generally into two classes, static and dynamic, wherein the static type includes those having some fixed decorations such as houses, boats for viewing only, which has scarcely an amusement effect; while the dynamic type includes in the bottom of a bottle a base, and a power supplying device in the base, which device is powered by a spring, some batteries or a motor for driving the decorations and playthings in the bottle to generate a regular motion, this type has a better effect of viewing and amusement; neglecting the static type, the dynamic type has the following defects though:

1) that which is powered by a spring is quite complicated in the mechanism thereof, expensive and having high failure rate, and is troublesome in tightening the spring, yet the time that the spring can afford power is very short, thus it is inconvenient in use.
2) that which is powered by some batteries or a motor is also quite complicated in the mechanism thereof including retarding gears, links etc., and is troublesome when assembled in a factory, the base and some members have to have molds for producing thereof, and is expensive in production (the cost to be transferred to the selling prices), yet the complex mechanical members have relative high failure rates, the users thereof must buy batteries or pay expensive electricity fee for the motor, the batteries require frequent change, these are the most bothersome matters of this type of bottle.
3) no matter powered by a spring or by batteries or a motor, the figurines to be driven are limited to those which have to be connected with the driving mechanism, so that the similarity of them to true living things is inferior, at least, a flying and dancing scene of birds, butterflies, dragonflies etc. can not be seen in a conventional viewing bottle.

SUMMARY OF THE INVENTION

In view of the above statement, the inventor of the present invention provides a "decorating and viewing bottle structure" capable of generating the animated flying and dancing scene of insects or birds without any energy source and having the effect of amusement.

The present invention will be apparent with regard to its structure and mode of use after reading the detailed description of the preferred embodiment thereof in reference to the accompanying drawings.

DETAILED DESCRIPTION OF THE PREFERRED EMBODIMENT

Figure 1:
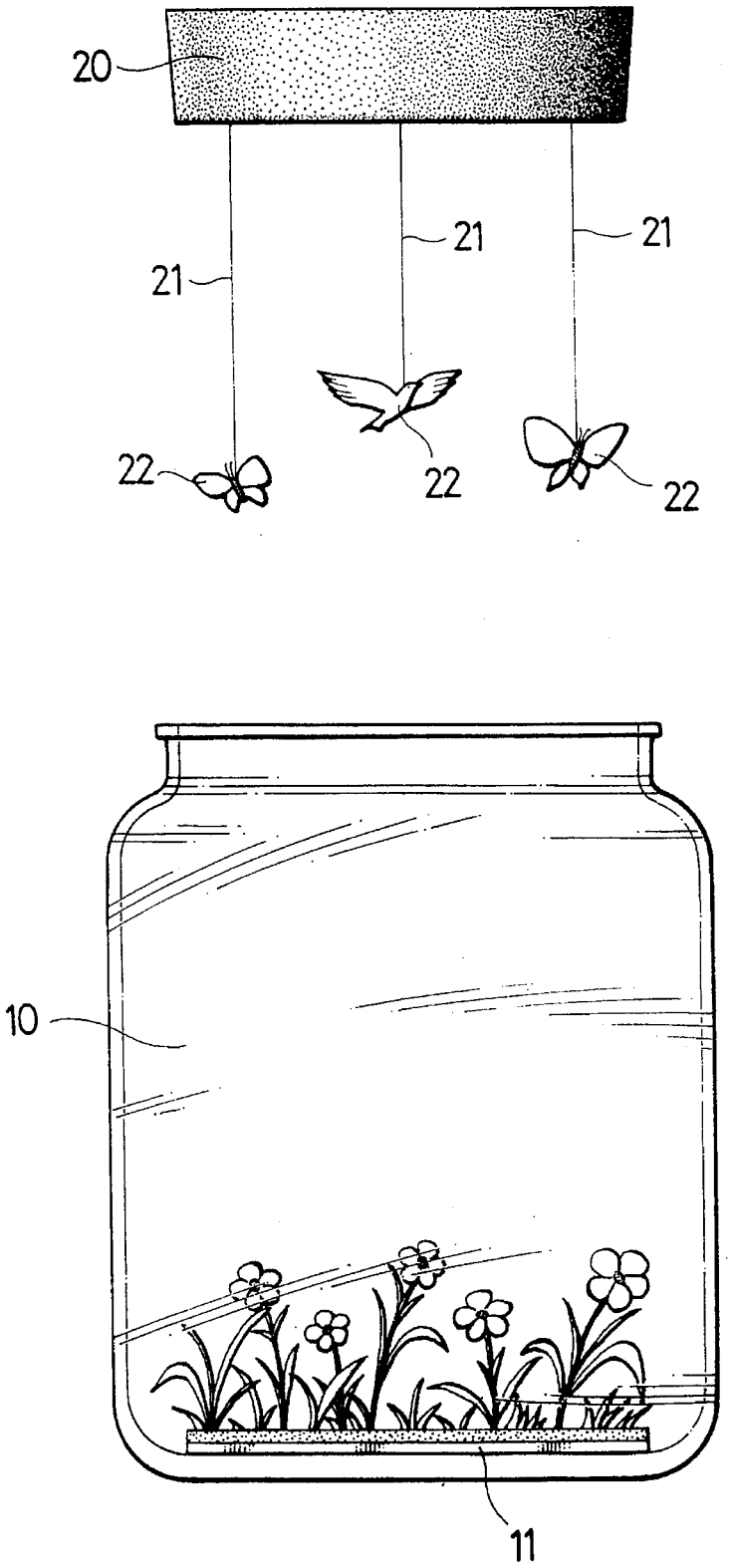
FIG. 1 is a schematic view of the present invention, showing the bottle body thereof is separated from its cover.

Referring to FIG. 1, the basic structure of the present invention is composed mainly of a bottle body 10 and a cover 20, wherein:

the bottle body 10: is wholly clear and transparent, a layer of magnetic iron 11 is provided on the bottom of the body 10, on the magnetic iron 11 there are arranged a lot of flowers and grasses.

the cover 20: can be used to fittedly cover the top opening of the bottle body 10, on the bottom thereof are a plurality of thin lines 21 having different lengths spaced appropriately with one another, and a plurality of figurines 22 carefully calculated to have different weights hanged on the lower ends of the lines 21, these figurines 22 may be birds, butterflies etc., each figurine 22 has a magnetic metal piece having the same polarity as that of the magnetic iron 11 in the bottle body 10. For example, if the magnetic iron has S polarity on its top face, then the figurines 22 all have S polarity; and if the magnetic iron has N polarity on its top face, then the figurines 22 all have N polarity.

Figure 2:
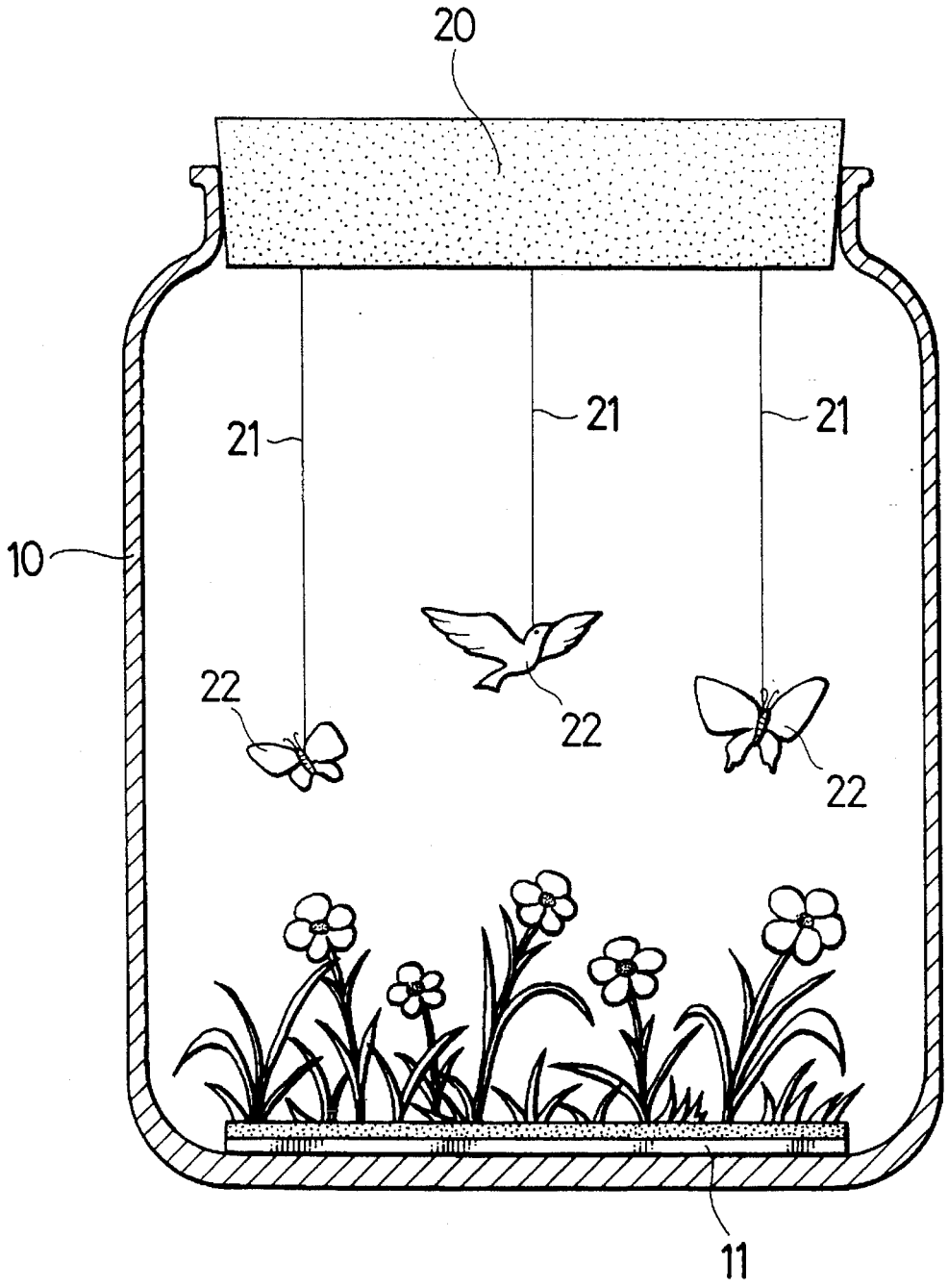
FIG. 2 is a schematic view of the present invention, showing the bottle body thereof is assembled with its cover.
Figure 3:
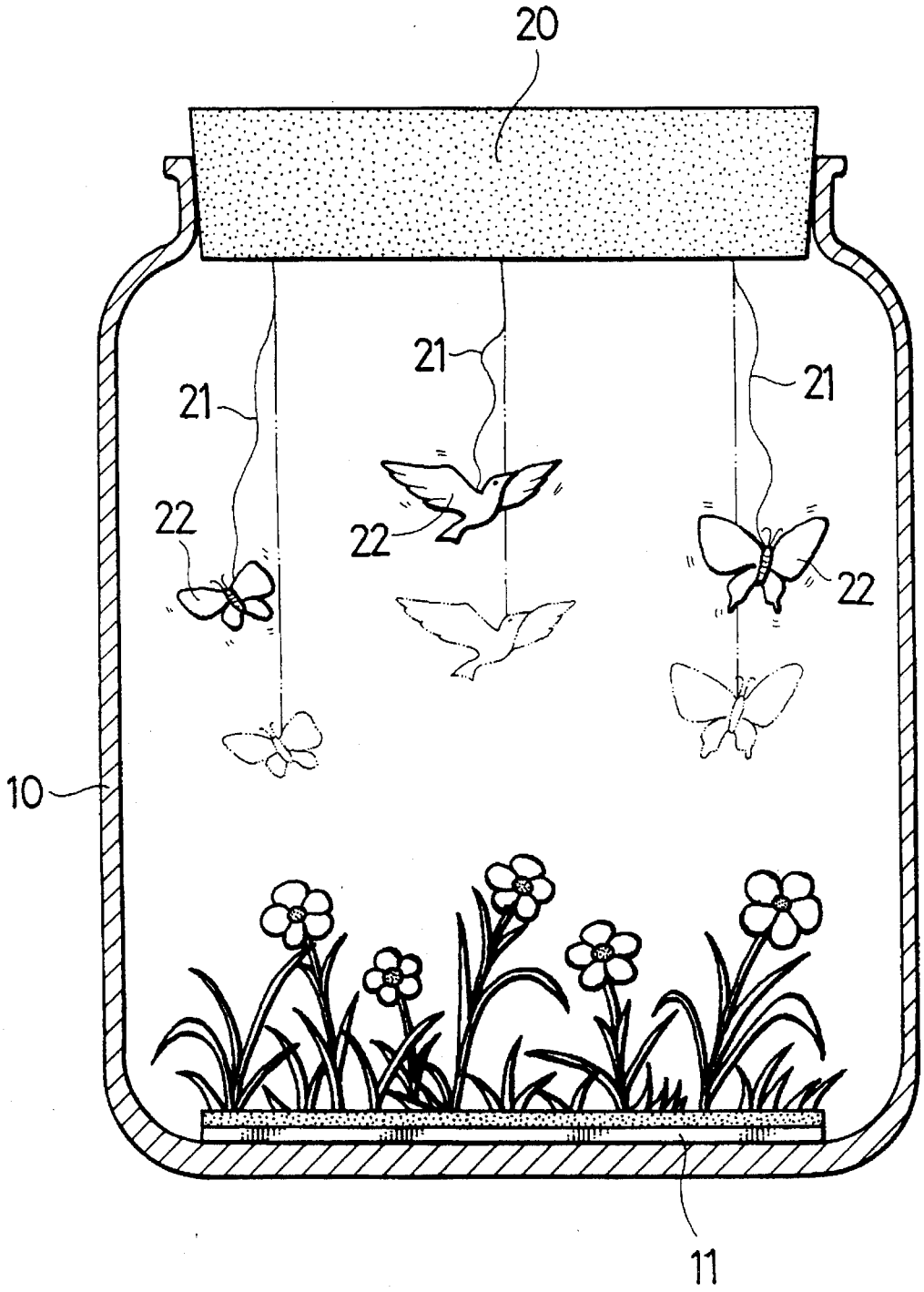
FIG. 3 is a schematic view of the present invention, showing a plurality of figurines flying and dancing in the bottle body.

Accordingly, as shown in FIG. 2, when the cover 20 and the bottle body 10 are assembled, the figurines 22 hanged on the cover 20 are above the flowers and grasses in the bottle body 10, due to the same polarity that the figurines 22 and the magnetic iron 11 posses, and due to the different lengths of the lines 21 on which the figurines 22 are hanged (i.e., the figurines 22 each has a different distance from the magnetic iron 11 plus the different weights of the figurines 22 (figurines on the shorter lines 21 are lighter, while those on the longer lines 21 are heavier), based on the mutual rejection force of those having the same polarity, the figurines 22 are raised when they generate rejection force with the magnetic iron 11, and fall down again by the attraction of the center of earth when they are raised to the distances where the magnetic rejection forces are attenuated enough. So that a flying and dancing scene of the figurines 22 of birds and insects etc. is obtained, and it is animate, delicate, and makes amusement when it is viewed; Such a design of the structure possesses the following advantages beside the value of decoration and viewing:

1) The action of the figurines 22 needs no energy source, no spring or battery is required, the operation is simple and convenient in use.
2) The whole structure is simplified, no transferring, no damage of friction, the failure rate thereof comes near to zero, hence its life of use is much prolonged.
3) Due to the simplicity of the structure, members therein are few, its assembly is easy, its cost of production is low, hence the selling price thereof can be low in favor of the consumers.
4) The flying and dancing dynamic scene of the figurines 22 of birds, insects etc. above the flowers and grasses has never seen in a conventional viewing bottle, the amusement value thereof is much higher than that of a conventional one.

Figure 4:
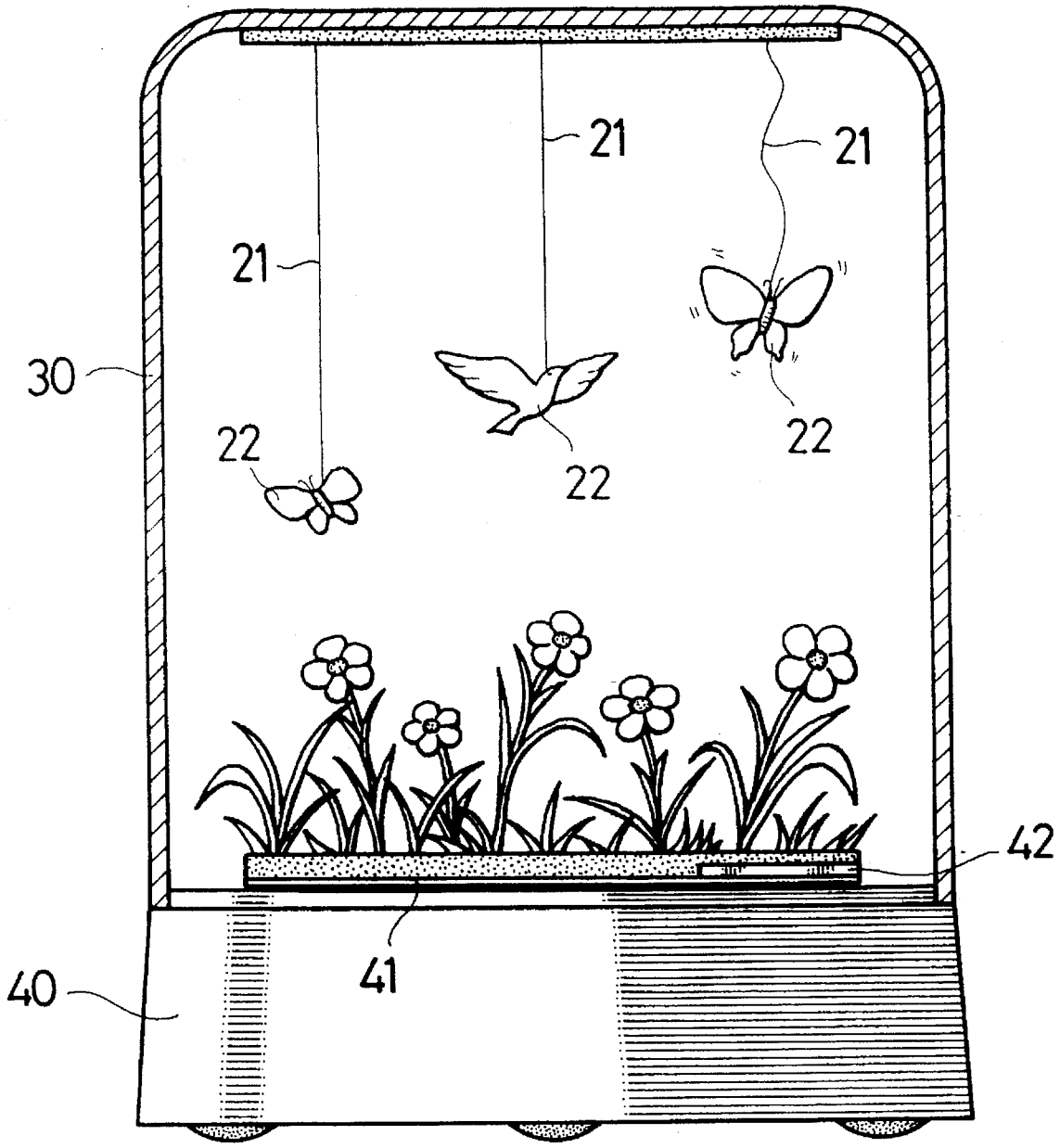
FIG. 4 shows that the embodiment of the present invention is installed on a music bell seat.

Further, the present invention can be installed on a rotating seat of music box to form a dynamic decoration, as shown in FIG. 4. A plurality of thin lines 21 are secured to a periphery of a circle affixed on the inner surface of the top of a clear hood 30 to support a plurality of figurines 22. The hood 30 is fixed on a music box seat 40, with a turntable 41 on the top surface of the seat 40. The turntable includes an eccentrically mounted magnetic iron 42. Flowers and grasses may be placed on the top surface of the turntable 41. The polarity on the top of the magnetic iron 42 is the same as that of the figurines 22. When the turntable 41 is rotated, the magnetic iron 42 moves along the periphery of a circle, and when it passes by each figurine 22, it will drive each to fly and dance, so as to form a flying and dancing scene of butterflies and birds etc. above the flowers and grasses, and this is amusing and animate.

In conclusion, the novel structure of the present invention not only gets rid of the limit and defects of the conventional viewing bottle, but also provides the above mentioned value of amusement and improvement of efficiency in use and production, and durability, it is novel, improved as well as pratical.

My invention may assume numerous forms and is to be construed as including all modifications and variations falling within the scope of the appended claims.

I claim:

1. A decoration and viewing bottle structure comprising:

a clear hood, and a music box seat with a turntable affixed to a top side thereof; wherein said hood includes a plurality of thin lines affixed to an inner side of a top surface of said hood, each of said lines supports a figurine so that said figurines are suspended above said turntable, and said turntable includes an eccentrically mounted magnetic element; and wherein said figurines include a magnetic element, a polarity of said magnetic element of said figurines being the same as that of said magnetic element of said turntable, and said hood is mounted on said music box seat such that when said turntable turns, said magnetic element in said turntable rotates about an interior of said hood, and said figurines are mounted such that their magnetic fields interact with that of said magnetic element of said turntable as it rotates under each figurine in turn, thereby causing said figurines to move such that said figurines appear to fly and dance.

2. The decoration and viewing bottle of claim 1 wherein:

flowers and grasses are supplied on a top surface of said turntable.

* * * * *